US011352759B2

(12) United States Patent
Legault

(10) Patent No.: US 11,352,759 B2
(45) Date of Patent: Jun. 7, 2022

(54) WICK DRAIN SHOE ASSEMBLIES, SYSTEMS, AND METHODS

(71) Applicant: American Piledriving Equipment, Inc., Kent, WA (US)

(72) Inventor: Eric C. Legault, Kirkland Lake (CA)

(73) Assignee: AMERICAN PILEDRIVING EQUIPMENT, INC., Kent, WA (US)

( * ) Notice: Subject to any disclaimer, the term of this patent is extended or adjusted under 35 U.S.C. 154(b) by 0 days.

(21) Appl. No.: 17/217,616

(22) Filed: Mar. 30, 2021

(65) Prior Publication Data

US 2022/0056656 A1 Feb. 24, 2022

Related U.S. Application Data

(60) Provisional application No. 63/069,329, filed on Aug. 24, 2020.

(51) Int. Cl.
*E02D 3/10* (2006.01)
*E02B 11/02* (2006.01)

(52) U.S. Cl.
CPC ..... *E02D 3/103* (2013.01); *E02B 11/02* (2013.01)

(58) Field of Classification Search
CPC ..... E02D 3/10; E02D 3/103; E02D 5/72
USPC ..... 405/50, 253, 255
See application file for complete search history.

(56) References Cited

U.S. PATENT DOCUMENTS

| | | | | |
|---|---|---|---|---|
| 3,881,319 A * | 5/1975 | Katagiri | E02D 3/103 | 405/50 |
| 7,736,091 B2 * | 6/2010 | Morizot | E02D 3/10 | 405/50 |
| 2002/0098044 A1 * | 7/2002 | White | E02D 11/00 | 405/232 |
| 2004/0146357 A1 * | 7/2004 | Goughnour | E02B 11/00 | 405/49 |
| 2005/0141964 A1 * | 6/2005 | Tomlinson | E02D 3/10 | 405/50 |
| 2008/0080932 A1 * | 4/2008 | Morizot | E02D 3/10 | 405/50 |
| 2016/0010306 A1 * | 1/2016 | Reinhall | E02D 13/005 | 405/228 |

FOREIGN PATENT DOCUMENTS

| | | | | |
|---|---|---|---|---|
| GB | 966349 A * | 8/1964 | E21B 17/04 | |
| KR | 200337861 Y1 * | 1/2004 | E21B 17/04 | |
| KR | 20120009396 A * | 2/2012 | | |

* cited by examiner

*Primary Examiner* — Frederick L Lagman
(74) *Attorney, Agent, or Firm* — Schacht Law Office, Inc.; Michael R. Schacht

(57) ABSTRACT

A wick drain shoe assembly adapted to be connected to a free end of a length of wick drain material and driven by a mandrel of a wick drain insertion system comprises a base portion, an extension portion secured to the base portion, and a wick drain shoe gasket. The wick drain material is connected to the wick drain shoe by securing the free end to the extension portion. The base portion is sized and dimensioned to engage the mandrel such that displacement of the mandrel in a first direction causes displacement of the wick drain shoe in the first direction. The wick drain shoe gasket is arranged between the mandrel and the base portion.

18 Claims, 6 Drawing Sheets

WICK DRAIN SHOE ASSEMBLIES, SYSTEMS, AND METHODS

RELATED APPLICATIONS

This application, U.S. patent application Ser. No. 17/217,616, filed Mar. 30, 2021, claims benefit of U.S. Provisional Application Ser. No. 63/069,329 filed Aug. 24, 2020, the contents of which are incorporated herein by reference.

TECHNICAL FIELD

The present invention relates to methods and apparatus for inserting into the earth and extracting from the earth flexible elongate members and, more particularly, to apparatus and methods for inserting wick drain material into the earth.

BACKGROUND

For certain construction projects, elongate members such as piles, anchor members, caissons, and mandrels for inserting wick drain material must be placed into and in some cases withdrawn from the earth. It is well-known that, in many cases, such rigid members may be driven into and withdrawn from the earth without prior excavation. The present invention is particularly advantageous when employed to insert a mandrel carrying wick drain material into the earth, and that application will be described in detail herein.

Wick drain material is flexible and thus cannot be directly driven into the earth. Instead, wick drain material is normally arranged at least partly within a rigid mandrel that is driven into the earth. Once the mandrel and wick drain material have been driven into the earth to a desired depth, the mandrel alone is removed from the earth, leaving the wick drain material in place. The wick drain material that is left in place wicks moisture in its vicinity to the surface.

To allow the mandrel to carry the wick drain material into the earth, the wick drain material is secured to a wick drain shoe, and the wick drain shoe is supported by the lower free end of the mandrel such that the driving the mandrel into the earth also drives the wick drain shoe, and the free end of the wick drain material secured thereto, into the earth. When the mandrel is removed, the wick drain shoe and at least a portion of the wick drain material, including the free end thereof are left in the ground.

Under certain soil conditions, soil and/or other debris can enter the mandrel as the mandrel drives the wick drain shoe into the ground. The need exists for improved wick drain shoe assemblies for inserting wick drain material into the ground that reduce or eliminate intrusion of soil and/or other debris into the mandrel.

SUMMARY

The present invention may be embodied as a wick drain shoe assembly adapted to be connected to a free end of a length of wick drain material and driven by a mandrel of a wick drain insertion system, the wick drain shoe assembly comprising a base portion, an extension portion secured to the base portion, and a wick drain shoe gasket. The wick drain material is connected to the wick drain shoe by securing the free end to the extension portion. The base portion is sized and dimensioned to engage the mandrel such that displacement of the mandrel in a first direction causes displacement of the wick drain shoe in the first direction. The wick drain shoe gasket is arranged between the mandrel and the base portion.

The present invention may also be embodied as a method of inserting wick drain material into the earth comprising the following steps. A wick drain shoe assembly comprising a base portion, an extension portion secured to the base portion, and a wick drain shoe gasket is formed. A free end of the wick drain material is connected to the extension portion of the wick drain shoe assembly. A mandrel is arranged such that the wick drain shoe gasket is between the mandrel and the base portion. The mandrel is displaced to drive the base portion, extension portion, and wick drain material into the earth.

The present invention may also be embodied as a wick drain insertion system configured to drive a free end of a length of wick drain material to a desired depth at a desired location, the wick drain insertion system comprising a support system, a drive system, a mandrel, a suspension system, and a wick drain shoe assembly. The wick drain shoe assembly comprises a base portion, an extension portion secured to the base portion, and a wick drain shoe gasket. The wick drain material is connected to the wick drain shoe by securing the free end to the extension portion. The base portion is sized and dimensioned to engage the mandrel such that displacement of the mandrel in a first direction causes displacement of the wick drain shoe in the first direction. The wick drain shoe gasket is arranged between the mandrel and the base portion.

DETAILED DESCRIPTION

The present invention may be embodied in a number of different forms, and several examples of the present invention will be described in detail below.

I. FIRST EXAMPLE WICK DRAIN SHOE ASSEMBLY AND FIRST EXAMPLE WICK DRAIN SHOE GASKET

Figure 1:
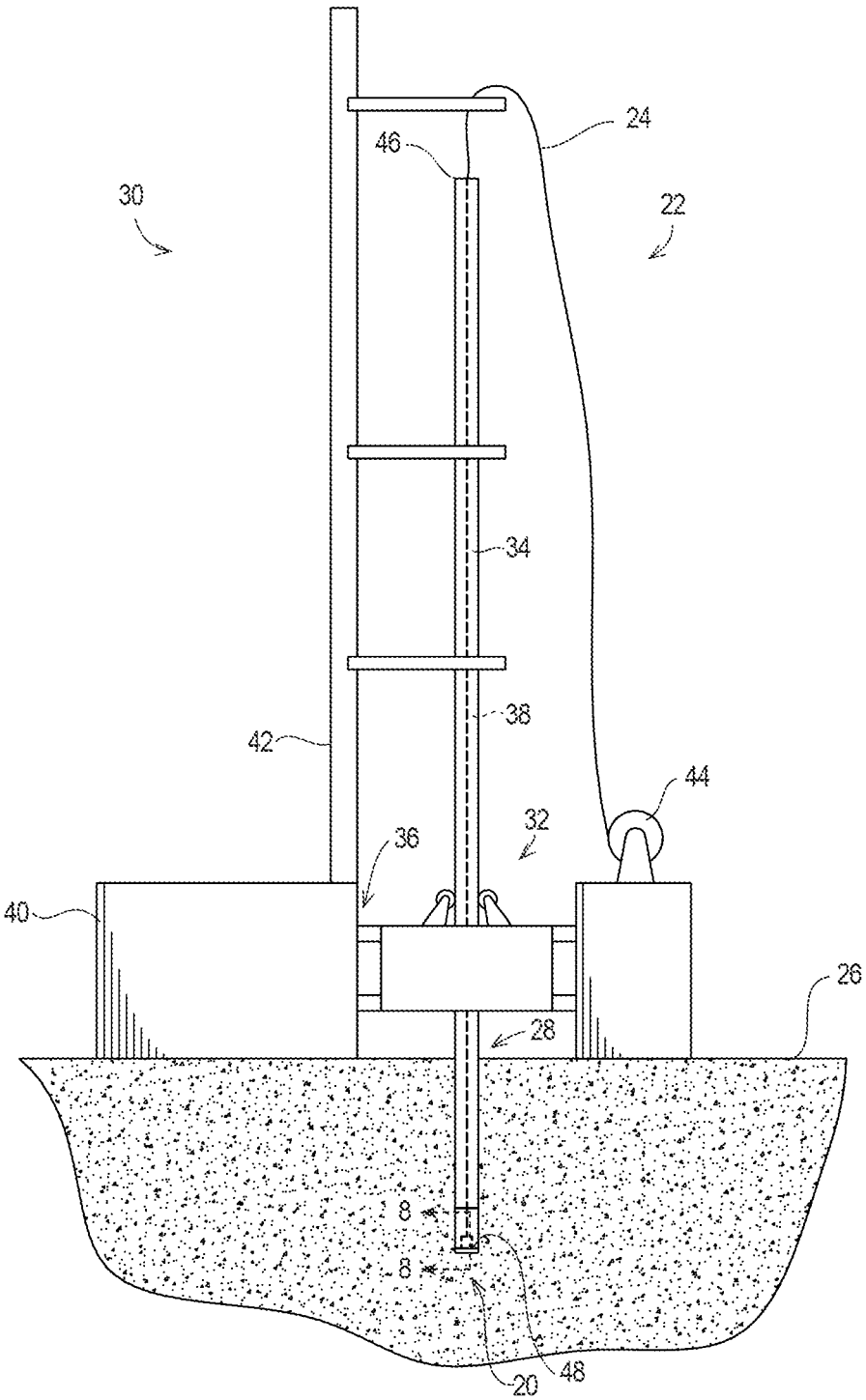
FIG. 1 is a somewhat schematic side elevation view of an example wick drain insertion system including a first example wick drain shoe of the present invention.

Referring initially to FIG. 1 of the drawing, depicted therein is a first example wick drain shoe assembly 20 used with a wick drain insertion system 22 to insert wick drain material 24 into the ground 26 at a desired location 28.

The example wick drain insertion system 22 is or may be conventional and comprises a support system 30, a drive system 32, a mandrel 34, and a suspension system 36. The example mandrel defines a mandrel cavity 38. The example support system 30 comprises a support base 40 and a support mast 42. In the example wick drain system 22, at least a portion of the wick drain material 24 is supported on a reel 44 mounted on the support base 40. Support systems, drive systems, mandrels, and suspension systems other than those described may be used in addition or instead.

The wick drain material 24 extends from the reel 44, into the mandrel cavity 38 through a mandrel upper end opening 46, and through the mandrel cavity 38 to the first example wick drain shoe 20 at a mandrel lower end opening 48. The example drive system 32 is supported by the example support base 40 such that the drive system 32 is arranged above the desired location 28. The example drive system 32 is configured to drive the mandrel 34 into the ground 26 at the desired location 28. The example suspension system 36 may be configured to support the drive system 32 relative to the support system 30.

Figure 5:
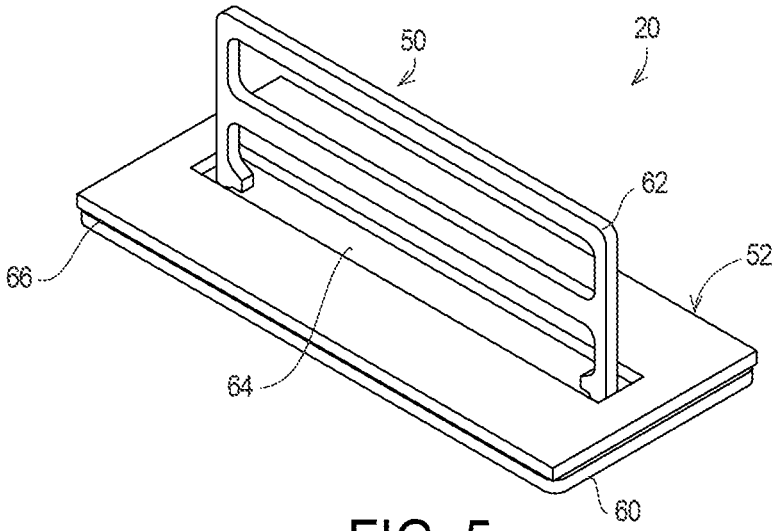
FIG. 5 is a perspective view of a first example wick drain shoe assembly comprising the first example wick drain shoe gasket.
Figure 6:
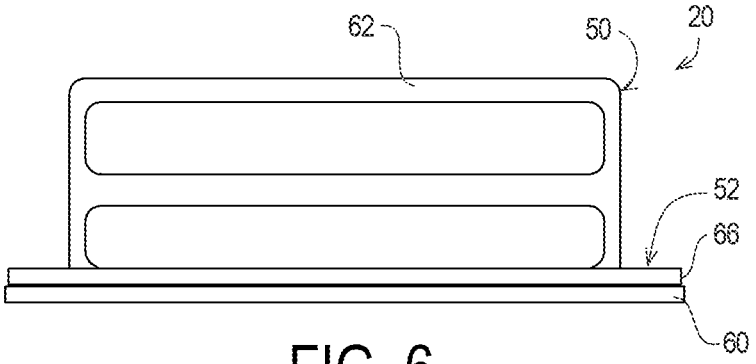
FIG. 6 is a front elevation view of the first example wick drain shoe assembly.
Figure 8:
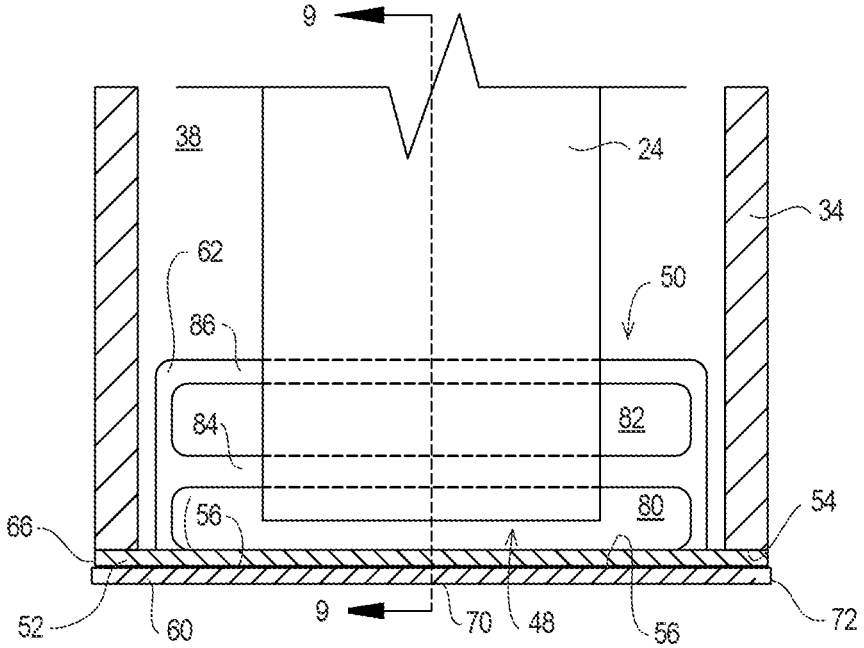
FIG. 8 is a front elevation section view taken along lines 8-8 in FIG. 1 illustrating the wick drain material connected to the first example wick drain shoe assembly and the engagement of a mandrel with the first example wick drain shoe assembly.

FIGS. 5 and 6 illustrate that the example wick drain shoe assembly 20 comprises a wick drain shoe 50 and a wick drain shoe gasket 52. As shown in FIG. 8, the wick drain shoe gasket 52 is arranged between a mandrel lower edge 54 defining the mandrel lower end opening 48 and a drive surface 56 defined by the wick drain shoe 50. As the mandrel 34 drives the first example wick drain shoe assembly 20 into the ground, the wick drain shoe gasket 52 is held between the mandrel lower edge 54 and the drive surface 56 such that the wick drain shoe gasket 52 inhibits passage of dirt and debris into the mandrel cavity 38 through the mandrel lower end opening 48.

Given the foregoing understanding of the basic construction and operation of the present invention, the details of construction and use of the first example wick drain shoe assembly 20 will now be described in further detail.

Figure 2:
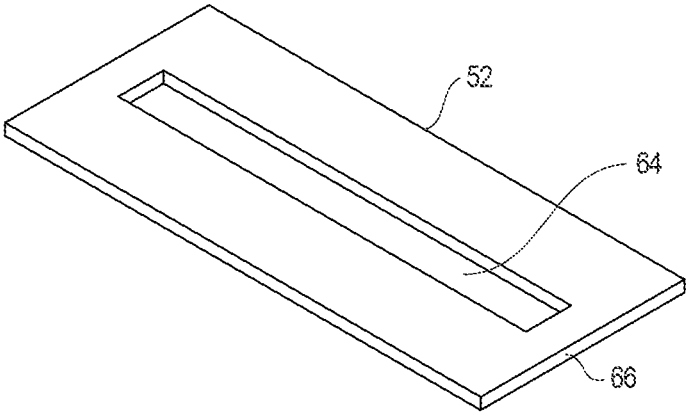
FIG. 2 is a perspective view of a first example wick drain shoe gasket of the present invention.
Figure 3:
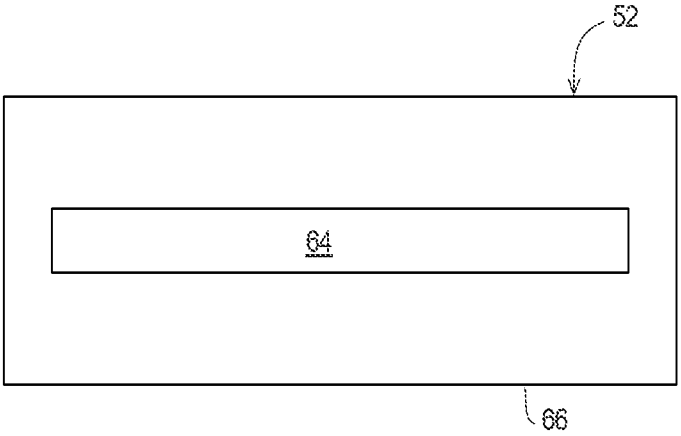
FIG. 3 is a top plan view of the first example wick drain shoe gasket.
Figure 4:
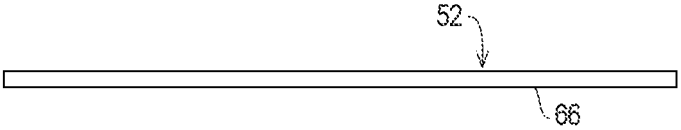
FIG. 4 is a front elevation view of the first example wick drain shoe gasket.
Figure 7:
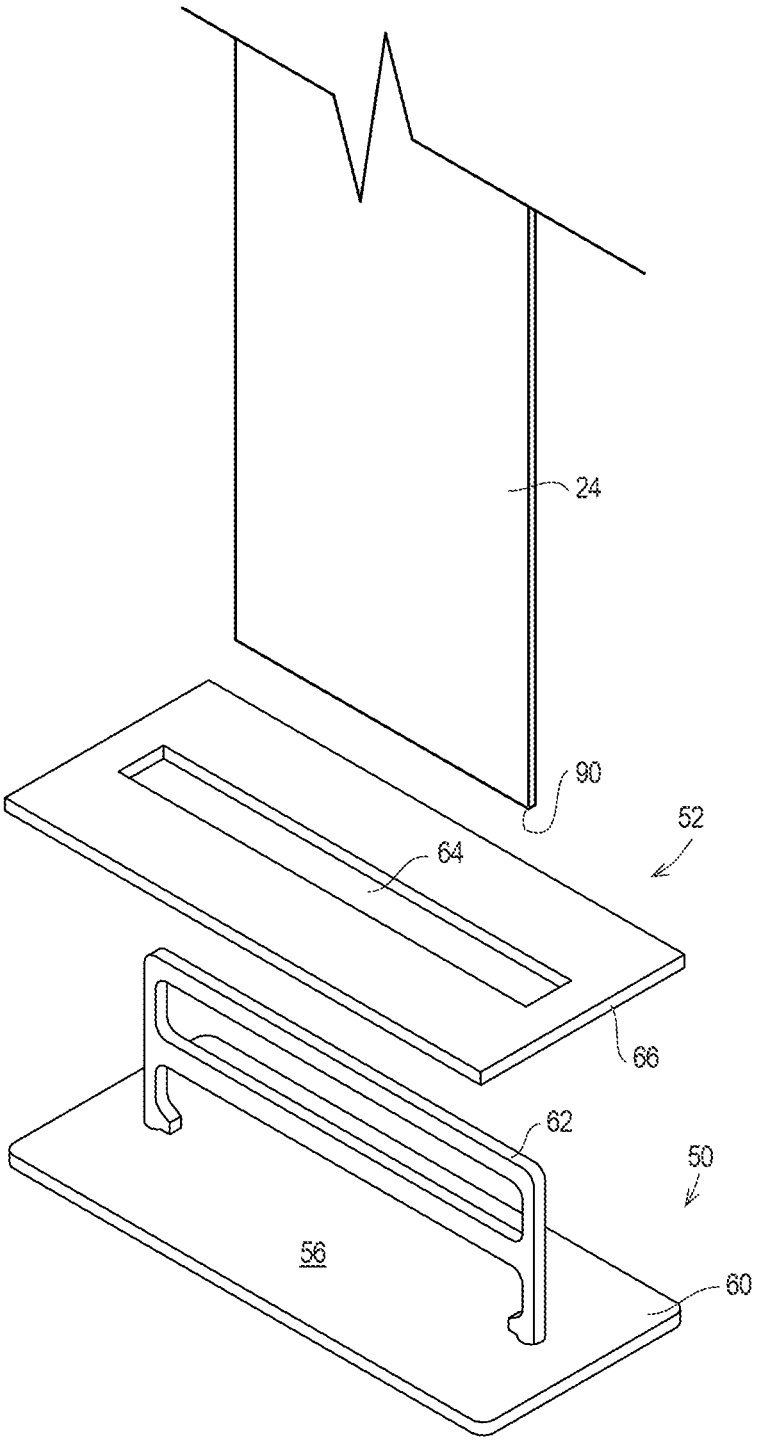
FIG. 7 is an exploded view depicting the formation of the first example wick drain shoe assembly and a first step in a process of connecting wick drain material to the first example wick drain shoe assembly.

As perhaps best shown in FIG. 7, the first example wick drain shoe 50 comprises a base portion 60 and an extension portion 62, and FIGS. 2, 3, and 7 illustrate that the first example wick drain shoe gasket 52 defines a gasket opening 64 and a gasket perimeter edge 66. The example base portion 60 is a plate defining a base lower surface 70, the drive surface 56, and a base perimeter edge 72. The example extension portion 62 is a plate defining first and second shoe openings 80 and 82. The extension portion 62 further defines an anchor portion 84 and a bearing portion 86. The example extension portion 62 is connected to the base portion 60 by welding or the like such that displacement of the base portion 60 is transmitted to the extension portion 62 during normal use of the wick drain shoe assembly 20.

Figure 9:
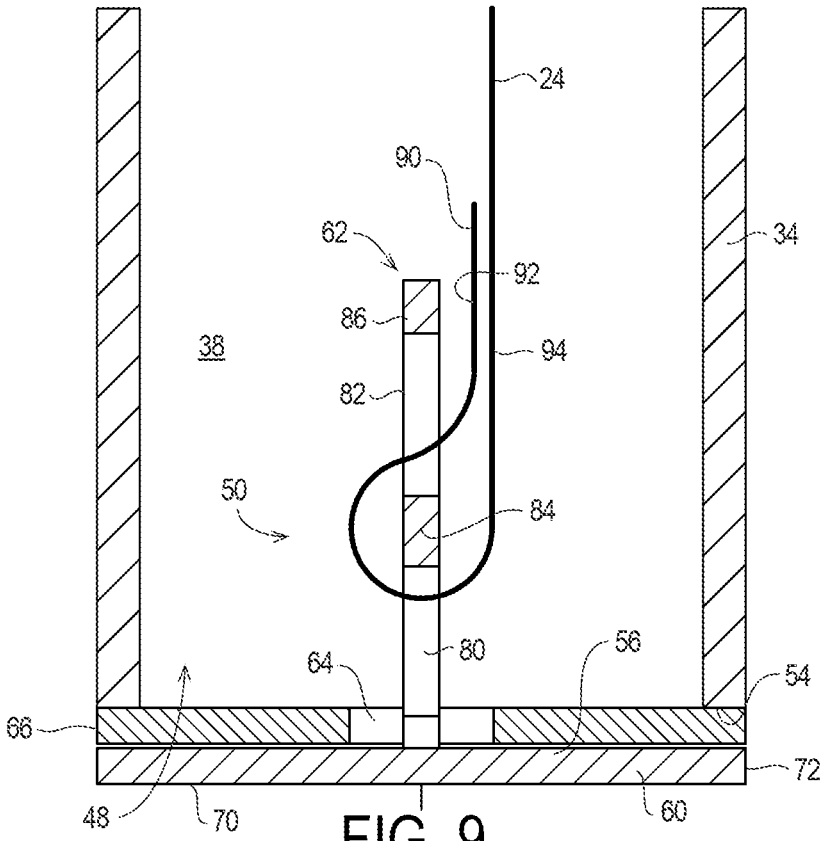
FIG. 9 is a side elevation section view taken along lines 9-9 in FIG. 8.

FIGS. 7-9 illustrate that the wick drain shoe assembly 20 is formed by displacing the wick drain shoe gasket 52 such that the extension portion 62 extends through the gasket opening 64 and the wick drain shoe gasket 52 lies on the drive surface 56 of the base portion 60. Further, the example gasket perimeter edge 66 is substantially aligned with the base perimeter edge 72 as shown by FIGS. 8 and 9.

FIGS. 8 and 9 illustrate that the extension portion 62 of the first example wick drain shoe assembly 20 extends into the mandrel cavity 38 through the mandrel lower opening 48. FIGS. 8 and 9 also illustrate that the base portion 60 of the first example wick drain shoe assembly 20 and the mandrel 34 are configured such that, with the first example wick drain shoe assembly 20 in a drive configuration relative to the mandrel 34, downward forces on the mandrel 34 are transmitted to the first example wick drain shoe assembly 20 and a free end 90 of the wick drain material 24 connected thereto. These downward forces further place the wick drain material 24 in tension, thereby securing the free end 54 of the wick drain material 24 relative to the first example wick drain shoe assembly 20 as describe above.

More specifically, FIG. 9 perhaps best illustrates that the free end 90 of the wick drain material 24 is passed through the first shoe opening 80 and then through the second shoe opening 82 such that the wick drain material 24 loops around the anchor portion 84 and such that at least a first portion 92 of the wick drain material 24 is between the bearing portion 58 and a second portion 94 of the wick drain material 24. Tension on the wick drain material 24 effectively clamps the first portion 92 of the wick drain material 24 between second portion 92 of the wick drain material and the bearing portion 86. At that point, friction inhibits movement of the free end 90 relative to the first example wick drain shoe assembly 20 and thus the free end 90 is carried with the first example wick drain shoe assembly 20 when the example wick drain shoe assembly 20 is displaced by the mandrel 34.

The base lower surface 70 is configured to engage the soil at the desired location 28 to allow the first example wick drain shoe assembly 20 to be driven into the ground 26 using the mandrel 34. Accordingly, the shape of the base perimeter edge 74 and of the mandrel 34 will be configured to match each other and to suit soil conditions at the desired location 28.

Any material capable of forming a seal appropriate to inhibit passage of dirt and debris into the mandrel cavity 38 through the mandrel lower end opening 48 and maintaining that seal while the wick drawing shoe assembly 20 is driven to the desired depth may be used to form the wick drain gasket 52. For example, the example wick drain gasket 52 may be made of a compressible material that allows the wick drain gasket 52 to deform or compress slightly when the mandrel lower edge 54 is held or forced into contact with the wick drain gasket 52.

II. SECOND EXAMPLE WICK DRAIN SHOE ASSEMBLY AND SECOND EXAMPLE WICK DRAIN SHOE GASKET

Figure 10:
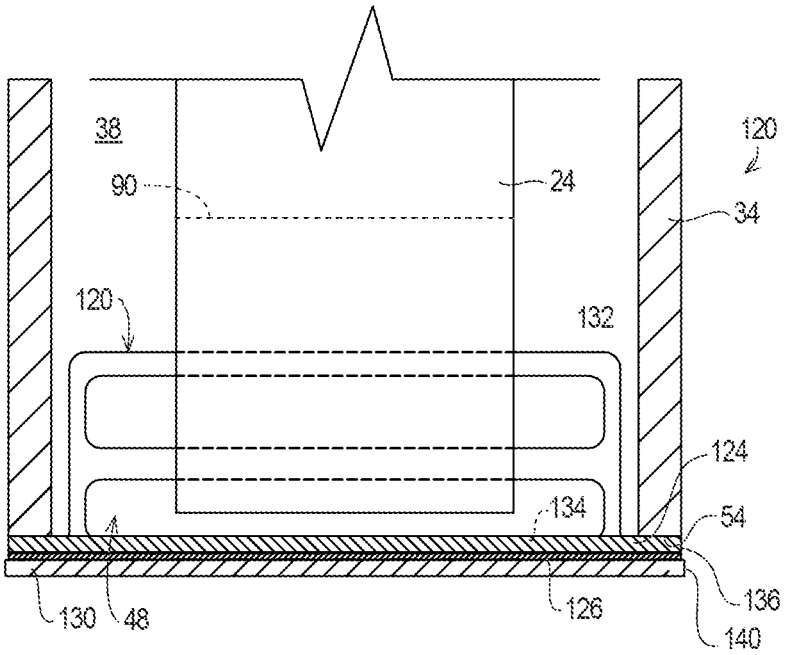
FIG. 10 is a front elevation section view similar to FIG. 8 illustrating wick drain material connected to a second example wick drain shoe assembly and the engagement of a mandrel with the second example wick drain shoe assembly.

Referring now to FIG. 10 of the drawing, depicted therein is a second example wick drain shoe assembly 120 constructed in accordance with, and embodying, the principles of the present invention. The second example wick drain shoe assembly 120 is used with a wick drain insertion system such as the wick drain insertion system 22 described above to insert wick drain material 24 into the ground as described above with respect to the first example wick drain shoe assembly 20.

The second example wick drain shoe assembly 120 comprises a wick drain shoe 122, a wick drain shoe gasket 124, and an adhesive layer 126. The example wick drain shoe 122 is similar to the example wick drain shoe 50 described above and comprises a base portion 130 and an extension portion 132. Like the example wick drain shoe gasket 52 described above, the example wick drain shoe gasket 124 defines a gasket opening 134 and a gasket perimeter edge 136. The example adhesive layer 126 is arranged to secure the wick drain shoe gasket 124 in place relative to the wick drain shoe 122. As shown in FIG. 10, the gasket perimeter edge 136 is adjacent to a base perimeter edge 140 of the base portion 130.

The example wick drain shoe 122 is or may be secured to the wick drain material 24 in generally the same manner as described above with reference to the first example wick drain shoe assembly 20. Also as described above with reference to the first example wick drain shoe 20, the wick drain mandrel 34 is arranged relative to the example wick drain shoe 122 such that downward displacement of the wick drain mandrel 34 downwardly displaces the base portion 130, the extension portion 132, and the free end 90 of the wick drain material 34.

Accordingly, as shown in FIG. 10, the wick drain mandrel 34 engages the wick drain shoe gasket 124 when driving the wick drain shoe assembly 120 into the ground. As the mandrel 34 drives the second example wick drain shoe assembly 120 into the ground, the second example wick drain shoe gasket 122 is held between the mandrel lower edge 54 and the base portion 130 such that the wick drain shoe gasket 122 inhibits passage of dirt and debris into the mandrel cavity 38 through the mandrel lower end opening 48.

Any material capable of forming a seal appropriate to inhibit passage of dirt and debris into the mandrel cavity 38 through the mandrel lower end opening 48 and maintaining that seal while the wick drawing shoe assembly 120 is driven to the desired depth may be used to form the wick drain gasket 124. For example, the example wick drain gasket 124 may be made of a compressible material that allows the wick drain gasket 124 to deform or compress slightly when the mandrel lower edge 54 is held or forced into contact with the wick drain gasket 124.

III. THIRD EXAMPLE WICK DRAIN SHOE ASSEMBLY AND THIRD EXAMPLE WICK DRAIN SHOE GASKET

Figure 11:
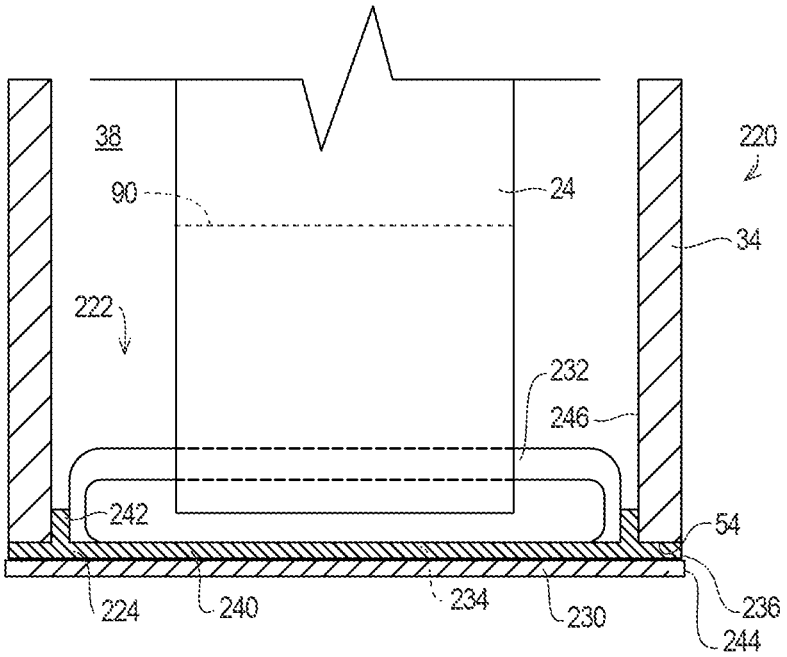
FIG. 11 is a front elevation section view similar to FIG. 8 illustrating wick drain material connected to a third example wick drain shoe assembly and the engagement of a mandrel with the third example wick drain shoe assembly.

Referring now to FIG. 11 of the drawing, depicted therein is a third example wick drain shoe assembly 220 constructed in accordance with, and embodying, the principles of the present invention. The third example wick drain shoe assembly 220 is used with a wick drain insertion system such as the wick drain insertion system 22 described above to insert wick drain material 24 into the ground as described above with respect to the first example wick drain shoe assembly 20.

The third example wick drain shoe assembly 220 comprises a wick drain shoe 222 and a wick drain shoe gasket 224. The example wick drain shoe 222 is similar to the example wick drain shoe 50 described above and comprises a base portion 230 and an extension portion 232. Like the example wick drain shoe gasket 52 described above, the example wick drain shoe gasket 224 defines a gasket opening 234 and a gasket perimeter edge 236.

The second example wick drain shoe gasket 224 further defines a main portion 240 and a projection portion 242. The main portion 240 is substantially planar, while the projection portion 242 is sized and dimensioned to be snugly received within the mandrel cavity 38. The main portion 240 of the third example wick drain shoe gasket 224 is arranged relative to base portion 230 such that the projection portion 242 extends from the main portion 240 away from the base portion 230. As shown in FIG. 11, the gasket perimeter edge 236 is adjacent to a base perimeter edge 244 of the base portion 230.

The example wick drain shoe 222 is or may be conventionally secured to the wick drain material 24. And as described above with reference to the first example wick drain shoe 20 and second example wick drain shoe 120, the wick drain mandrel 34 is arranged relative to the third example wick drain shoe 222 such that downward displacement of the wick drain mandrel 34 downwardly displaces the base portion 230, the extension portion 232, and the free end 90 of the wick drain material 34.

FIG. 11 also shows that the wick drain mandrel 34 engages the wick drain shoe gasket 224 when driving the wick drain shoe assembly 220 into the ground. In particular, as the mandrel 34 drives the third example wick drain shoe assembly 220 into the ground, the third example wick drain shoe gasket 222 is held between the mandrel lower edge 54 and the base portion 230 such that the wick drain shoe gasket 222 inhibits passage of dirt and debris into the mandrel cavity 38 through the mandrel lower end opening 48. The projection portion 242 of the third example wick drain shoe gasket 224 extends up along an inner surface 246 of the mandrel and into mandrel cavity 38 through the mandrel lower end opening 48 to create greater surface area between the wick drain mandrel 34 and the wick drain shoe gasket 224. The increased overlap between the surface of the wick drain shoe gasket 224 and the inner surface 246 of the mandrel enhances an ability of the wick drain shoe gasket 222 to inhibit passage of dirt and debris into the mandrel cavity 38 through the mandrel lower end opening 48.

Any material capable of forming a seal appropriate to inhibit passage of dirt and debris into the mandrel cavity 38 through the mandrel lower end opening 48 and maintaining that seal while the wick drawing shoe assembly 220 is driven to the desired depth may be used to form the wick drain gasket 224. For example, the example wick drain gasket 224 may be made of a compressible material that allows the wick drain gasket 224 to deform or compress slightly when the mandrel lower edge 54 is held or forced into contact with the wick drain gasket 224.

IV. ADDITIONAL CONSIDERATIONS

Multiple styles or types of wick drain shoes can be combined with a wick drain shoe gasket, such as the wick drain shoe gaskets 20, 120, and 220 described above, to form a wick drain shoe assembly of the present invention. For example, co-pending U.S. Provisional Patent Application Ser. No. 63/056,437 describes a number of wick drain shoes similar to the wick drain shoes 50 and 122 that may be combined with a wick drain shoe gasket such as the example wick drain shoe gaskets 20, 120, and 220 described herein. In addition, any of the wick drain shoe gaskets 20, 120, and 220 described herein may be combined with a conventional wick drain shoe such as the example wick drain shoe 222 described herein.

Further, an adhesive layer such as the adhesive layer 126 may be used with the first example wick drain shoe assembly 20, the third example wick drain shoe assembly 220, or any of the other wick drain shoes depicted in co-pending U.S. Provisional Patent Application Ser. No. 63/056,437.

What is claimed is:

1. A wick drain shoe assembly adapted to be connected to a free end of a length of wick drain material and driven by a mandrel of a wick drain insertion system, the wick drain shoe assembly comprising:

a base portion;

an extension portion secured to the base portion; and a wick drain shoe gasket made of compressible material; wherein the wick drain material is connected to the wick drain shoe by securing the free end to the extension portion;

the wick drain shoe gasket is supported by the base portion;

the base portion is sized and dimensioned such that displacement of the mandrel in a first direction applies a force to the base portion through the wick drain shoe gasket to displace the wick drain shoe in the first direction;

the wick drain shoe gasket is sized, dimensioned, and arranged between the mandrel and the base portion such that, when the wick drain shoe is displaced in the first direction, passage of dirt and debris between the wick drain mandrel and the base portion is substantially inhibited; and after removal of the mandrel, the wick drain shoe assembly and at least portion of the wick drain material remain in the earth.

2. A wick drain shoe assembly as recited in claim 1, in which:

the mandrel defines a mandrel lower edge; and the mandrel lower edge is configured to engage the wick drain shoe gasket.

3. A wick drain shoe assembly as recited in claim 1, in which:

the mandrel defines a mandrel cavity and a mandrel lower end opening; and the wick drain shoe gasket is configured to inhibit passage of dirt and debris into the mandrel cavity through the mandrel lower end opening.

4. A wick drain shoe assembly as recited in claim 1, in which:

the mandrel defines a mandrel cavity, a mandrel lower end opening, and mandrel lower edge, where the mandrel lower edge extends around the mandrel lower edge opening; and the wick drain shoe gasket is configured to inhibit passage of dirt and debris into the mandrel cavity through the mandrel lower end opening.

5. A wick drain shoe assembly as recited in claim 1, in which:

the base portion defines a base perimeter edge;

the wick drain shoe gasket defines a gasket perimeter edge; and the gasket perimeter edge is substantially aligned with the base perimeter edge during displacement of the wick drain shoe in the first direction.

6. A wick drain shoe assembly as recited in claim 1, in which:

the mandrel defines a mandrel lower edge;

the base portion defines a base perimeter edge;

the wick drain shoe gasket defines a gasket perimeter edge; and the mandrel lower edge, the gasket perimeter edge, and the base perimeter edge are substantially aligned during displacement of the wick drain shoe in the first direction.

7. A method of inserting wick drain material into the earth, comprising the steps of:

forming a wick drain shoe assembly comprising a base portion, an extension portion secured to the base portion, and a wick drain shoe gasket made of compressible material;

connecting a free end of the wick drain material to the extension portion of the wick drain shoe assembly;

arranging a mandrel such that the wick drain shoe gasket is between the mandrel and the base portion;

displacing the mandrel in a first direction such that the mandrel engages the wick drain shoe gasket such that a force is applied to the base portion through the wick drain shoe gasket to drive the base portion, extension portion, and wick drain material into the earth; and removing the mandrel such that the wick drain shoe assembly and at least portion of the wick drain material remain in the earth.

8. A method as recited in claim 7, in which the mandrel defines a mandrel lower edge, the method further comprising the step of configuring the mandrel lower edge to engage the wick drain shoe gasket.

9. A method as recited in claim 7, in which the mandrel defines a mandrel cavity and a mandrel lower end opening, the method further comprising the step of configuring the wick drain shoe gasket to inhibit passage of dirt and debris into the mandrel cavity through the mandrel lower end opening.

10. A method as recited in claim 7, in which the mandrel defines a mandrel cavity, a mandrel lower end opening, and mandrel lower edge, where the mandrel lower edge extends around the mandrel lower edge opening, the method further comprising the step of configuring the wick drain shoe gasket to inhibit passage of dirt and debris into the mandrel cavity through the mandrel lower end opening.

11. A method as recited in claim 7, in which:

the step of forming the wick drain shoe assembly comprises the steps of defining a base perimeter edge on the base portion, and defining a gasket perimeter edge on the wick drain shoe gasket; and the step of arranging the mandrel comprises the step of substantially aligning the gasket perimeter edge with the base perimeter edge.

12. A method as recited in claim 7, in which the mandrel defines a mandrel lower edge, where:

the step of forming the wick drain shoe assembly comprises the steps of defining a base perimeter edge on the base portion, and defining a gasket perimeter edge on the wick drain shoe gasket; and the step of arranging the mandrel comprises the step of substantially aligning the gasket perimeter edge with the base perimeter edge.

13. A wick drain insertion system configured to drive a free end of a length of wick drain material to a desired depth at a desired location, the wick drain insertion system comprising a support system;

a drive system;

a mandrel;

a suspension system; and a wick drain shoe assembly comprising:

a base portion, an extension portion secured to the base portion, and a wick drain shoe gasket made of compressible material;

wherein the wick drain shoe gasket is supported by the base portion;

the wick drain material is connected to the wick drain shoe by securing the free end to the extension portion;

the base portion is sized and dimensioned to such that displacement of the mandrel in a first direction applies a force to the base portion through the wick drain shoe gasket to displace the wick drain shoe in the first direction; and the wick drain shoe gasket is sized, dimensioned, and arranged between the mandrel and the base portion such that, when the wick drain shoe is displaced in the first direction, passage of dirt and debris between the wick drain mandrel and the base portion is substantially inhibited; and after removal of the mandrel, the wick drain shoe assembly and at least portion of the wick drain material remain in the earth.

14. A wick drain insertion system as recited in claim 13, in which:

the mandrel defines a mandrel lower edge; and the mandrel lower edge is configured to engage the wick drain shoe gasket.

15. A wick drain insertion system as recited in claim 13, in which:

the mandrel defines a mandrel cavity and a mandrel lower end opening; and the wick drain shoe gasket is configured to inhibit passage of dirt and debris into the mandrel cavity through the mandrel lower end opening.

16. A wick drain insertion system as recited in claim 13, in which:

the mandrel defines a mandrel cavity, a mandrel lower end opening, and mandrel lower edge, where the mandrel lower edge extends around the mandrel lower edge opening; and the wick drain shoe gasket is configured to inhibit passage of dirt and debris into the mandrel cavity through the mandrel lower end opening.

17. A wick drain insertion system as recited in claim 13, in which:

the base portion defines a base perimeter edge;

the wick drain shoe gasket defines a gasket perimeter edge; and the gasket perimeter edge is substantially aligned with the base perimeter edge during displacement of the wick drain shoe in the first direction.

18. A wick drain insertion system as recited in claim 13, in which:

the mandrel defines a mandrel lower edge;

the base portion defines a base perimeter edge;

the wick drain shoe gasket defines a gasket perimeter edge; and the mandrel lower edge, the gasket perimeter edge, and the base perimeter edge are substantially aligned during displacement of the wick drain shoe in the first direction.

* * * * *